US006684780B2

(12) United States Patent
Shiraishi

(10) Patent No.: US 6,684,780 B2
(45) Date of Patent: Feb. 3, 2004

(54) INK CONTROL IN PRINTING PRESS

(75) Inventor: Yasuhito Shiraishi, Kyogo (JP)

(73) Assignee: Dainippon Screen Mfg. Co., Ltd., Kyoto (JP)

( * ) Notice: Subject to any disclaimer, the term of this patent is extended or adjusted under 35 U.S.C. 154(b) by 0 days.

(21) Appl. No.: 10/347,442

(22) Filed: Jan. 21, 2003

(65) Prior Publication Data

US 2003/0107609 A1 Jun. 12, 2003

Related U.S. Application Data

(62) Division of application No. 09/804,380, filed on Mar. 13, 2001, now Pat. No. 6,539,863.

(30) Foreign Application Priority Data

Mar. 13, 2000 (JP) ..... P2000-069062

(51) Int. Cl.[7] ..... B41F 31/02; B41J 2/01

(52) U.S. Cl. ..... 101/365; 347/104

(58) Field of Search ..... 101/DIG. 45, 211, 101/171, 365, 350; 364/526, 578; 356/402; 347/14, 15, 19, 131, 104

(56) References Cited

U.S. PATENT DOCUMENTS

| | | | | |
|---|---|---|---|---|
| 4,555,180 | A | | 11/1985 | Masuda et al. |
| 5,182,721 | A | | 1/1993 | Kipphan et al. |
| 5,357,448 | A | * | 10/1994 | Stanford ..... 364/526 |
| RE35,495 | E | | 4/1997 | Bolza-Schuenemann et al. |
| 5,903,712 | A | | 5/1999 | Wang et al. |
| 6,009,807 | A | | 1/2000 | Yoshida et al. |
| 6,041,708 | A | | 3/2000 | Kipphan et al. |

FOREIGN PATENT DOCUMENTS

| | | |
|---|---|---|
| DE | 44 36 583 | 4/1996 |
| EP | 0 143 744 | 6/1985 |
| EP | 0 518 559 | 12/1992 |
| EP | 0 767 059 | 4/1997 |
| JP | 2824334 | 9/1998 |
| JP | 10-272756 | 10/1998 |
| JP | 11-268394 | 10/1999 |
| WO | 92/12011 | 7/1992 |

* cited by examiner

*Primary Examiner*—Stephen D. Meier
*Assistant Examiner*—An H. Do
(74) *Attorney, Agent, or Firm*—McDermott, Will & Emery

(57) ABSTRACT

First image data is converted into numerical values in accordance with an L*a*b* color coordinate system for regions of each ink key of an ink feeding unit to obtain reference color data. A print color data operating unit processes image data, obtained from actually printed image of the first image data, by the same technique as the reference color data operation to obtain print color data. The reference color data is compared with the print color data in each ink key region, to operate differential data. The density value of each ink of Y, M, C, K is calculated from the differential data. In each color, obtained is correction data expressing the correction amount of the aperture of the ink key corresponding to this density value. A controller adjusts the aperture of the ink key of each ink feeding unit on the basis of the correction data.

8 Claims, 11 Drawing Sheets

INK CONTROL IN PRINTING PRESS

This application is a divisional of Application Ser. No. 09/804,380 filed Mar. 13, 2001.

BACKGROUND OF THE INVENTION

1. Field of the Invention

The present invention relates to a printing press, and more particularly to improvement in ink feed control.

2. Description of the Background Art

Recently, printing press having a main body including a plate making device for forming an image on a printing plate on the basis of digital image data are being widely used, which are known as a CTP (computer-to-plate) machine. A First conventional printing press is called a digital printing press, which is suited to short jobs for printing operations of multiple types and small number of printed sheets because printed sheets are directly obtained from the image data. In the digital printing press, the plate making process is automated so that it can be handled easily by an inexperienced operator, but further automation is demanded in ink supply control in the printing process.

In the ink feed control in the conventional printing press, generally, a color measurement console connected to the printing press is used, but in this case, the operator has to pick up proper print samples to measure the color of the printed sheet. By the color measurement console, usually, a color chart provided in the print sheet is measured.

To solve this problem, a second conventional printing press having means for detecting an image of a print sheet has been developed. In this second prior art, the image of the printed sheet is detected by an image detector provided on an impression cylinder of the printing press to obtain image data. This image data is compared with reference image data obtained preliminarily by reading a reference image, to control the ink feed rate. According to the second prior art, since the image of the print is detected in the printing press, the operator is not required unlike the case of using a color measurement console. Another advantage is that the color chart is not necessary because the image on the print sheet is used.

In the second prior art, however, the reference printed sheet must be prepared. Such printed sheet is a proof sheet or a favorable sheet previously obtained during printing process, which is known as "an OK-sheet". Lately, however, proof sheets are often obtained by a simple proof press using an ink jet printer or the like, and a reference printed sheet to be used as a reference in the printing press is not always prepared beforehand. In the method making an OK-sheet during printing, the ink feed must be controlled manually until an OK-sheet is obtained. Thus, the method is applicable only in mass printing, and it is not economical in time and number of printed sheets in printing operations for obtaining a small number of printed sheets. It is hence in appropriate in the digital printing press suited to printing operations of multiple types and small number of printed sheets.

Further, in the second prior art, means for detecting the image of a printed sheet is provided near an impression cylinder. In this case, it is difficult to detect the image of the printed sheet over the entire area. That is, when detecting the image of the rear end of the printing sheet, the leading end is already caught by another cylinder (for example, discharge cylinder), and the rear end of the printing sheet is not fixed to the impression cylinder. In such a case, along with the move of the printing sheet, the rear end side fluctuates and the image thereof may not be detected properly.

Further, as in the second prior art, in a satellite type printing press in which plurality of blanket cylinders contacting with the impression cylinder, enough space for disposing the image detecting means may not be provided near the impression cylinder.

SUMMARY OF THE INVENTION

The invention is directed to a printing press for printing an image on a printing sheet on the basis of first image data.

According to the invention, the printing press comprises plate making means for forming an image on a printing plate on the basis of the first image data, ink feed means capable of changing ink feed rates of ink supplied onto a plurality of regions of the printing plate, reference color data operating means for converting the first image data into a predetermined color coordinate system for each one of the plurality of regions, and storing color values obtained as reference color data, image-detecting means for detecting an image on the printing sheet transferred from the printing plate to thereby obtain second image data, print color data operating means for converting the second image data into the color coordinate system for each one of the plurality of regions to obtain print color data, differential data operating means for comparing the reference color data with the print color data for each one of the plurality of regions to obtain differential data, correction data operating means for obtaining correction data for the ink feed rates on the basis of the differential data, and control means for controlling the ink feed rates to be fed onto the plurality of regions by the ink feed means on the basis of the correction data.

In this printing press, the ink feed can be automated without preparing the reference print sheet.

In other aspect of the invention, the printing press comprise plate making means for adding a color chart image data expressing a predetermined color chart to the first image data to generate combined image data, and forming an image corresponding to the combined image data on a printing plate, sink feed means capable of changing ink feed rates of ink supplied onto a plurality of regions of the printing plate, reference color data storage means for storing a numerical value of each color included in the color chart in a predetermined color coordinate system as reference color data, image-detecting means for detecting an image on the printing sheet transferred from the printing plate to thereby obtain second image data, print color data operating means for converting the second image data into the color coordinate system for each one of the plurality of regions to obtain print color data, differential data operating means for comparing the reference color data with the print color data for each one of the plurality of regions to obtain differential data, correction data operating means for obtaining correction data of the ink feed rate on the basis of the differential data, and control means for controlling the ink feed rates to be fed into the plurality of regions by the ink feed means on the basis of the correction data.

Preferably, the printing press further comprises color chart storage means for storing the color chart image data. The plate making means adds the color chart image data being read out from the color chart storage means to the first image data, and generates the combined image data.

In a preferred embodiment of the invention, the printing sheet has a leading end and a rear end. The printing press further comprises discharge means for delivering the printing sheet by gripping the leading end, and stabilizing means for stabilizing a conveying state of the printing sheet being discharged. The image-detecting means detects the image on the printing sheet stabilized by the stabilizing means in the conveying state.

In a preferred embodiment of the present invention, the printing press further comprises a discharge storage for stacking up and accumulating a plurality of printed sheets sequentially on a platform. The image-detecting means has two-dimensional image-detecting means capable of detecting a whole image region of a top printing sheet of a plurality of printing sheets stacked up on the discharge storage.

The invention is also directed to a method of controlling the ink feed rate in the printing press.

According to the invention, the method comprises the steps of obtaining reference digital color data by converting first digital data expressing colors into a predetermined color coordinate system, providing a printing mechanism with color inks corresponding to the first digital data, transferring the color inks onto a printing sheet from the printing mechanism, obtaining second digital data by detecting colors on the printing sheet, and controlling color ink feed rates in the printing mechanism in response to a difference of the first data and the second digital data by a feedback control.

Accordingly, an object of the invention is to provide a printing press capable of automatically controlling an appropriate ink feed rate without preparing any reference print.

It is other object of the invention to detect an image favorably even in the rear end of a printed sheet by disposing imaging means in other area than the vicinity of the impression cylinder.

These and other objects, features, aspects and advantages of the present invention will become more apparent from the following detailed description of the present invention when taken in conjunction with the accompanying drawings.

DESCRIPTION OF THE PREFERRED EMBODIMENTS

1. First Preferred Embodiment

Figure 1:
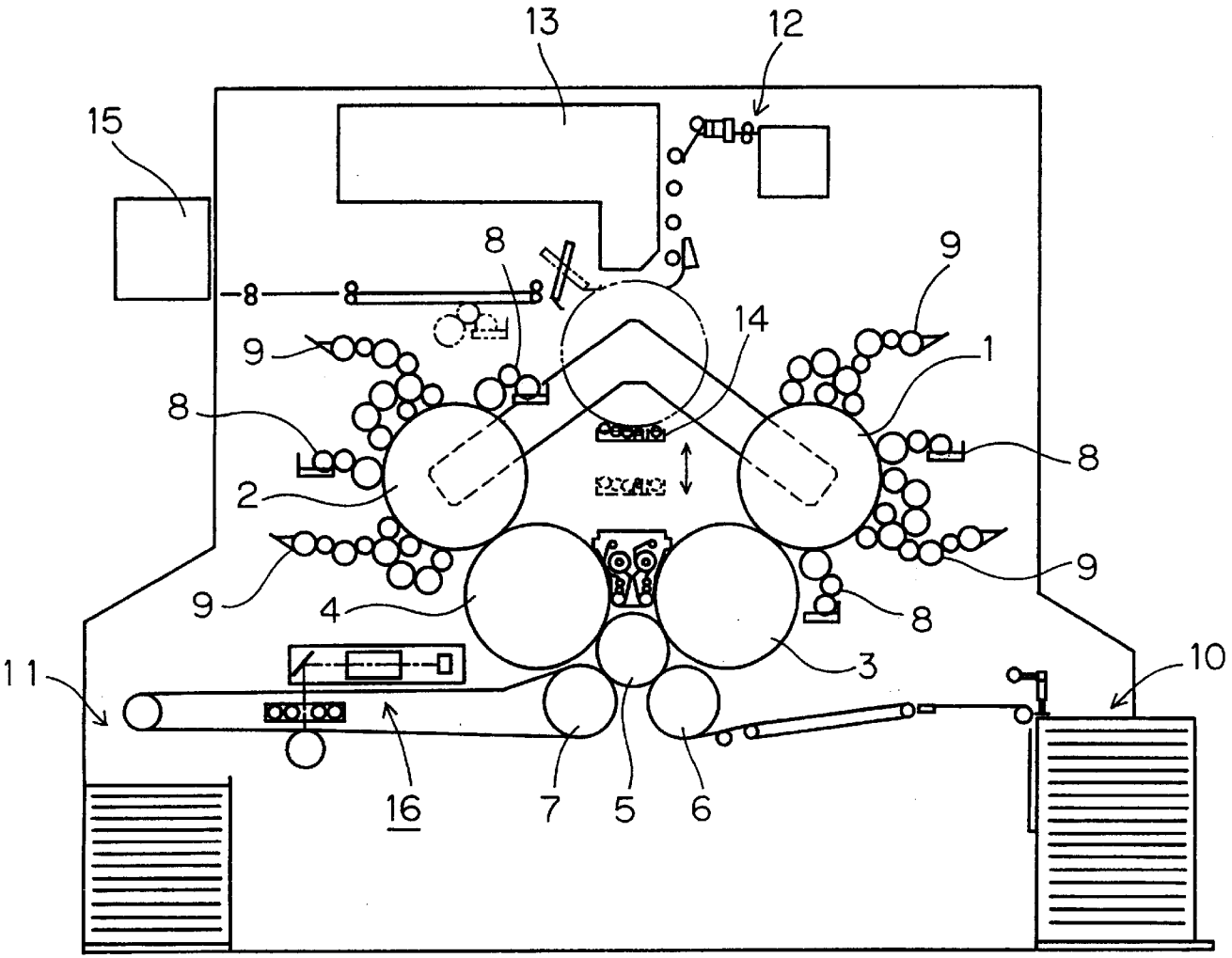
FIG. 1 is a schematic side view showing a printing press according to a preferred embodiment of the invention.
Figure 2:
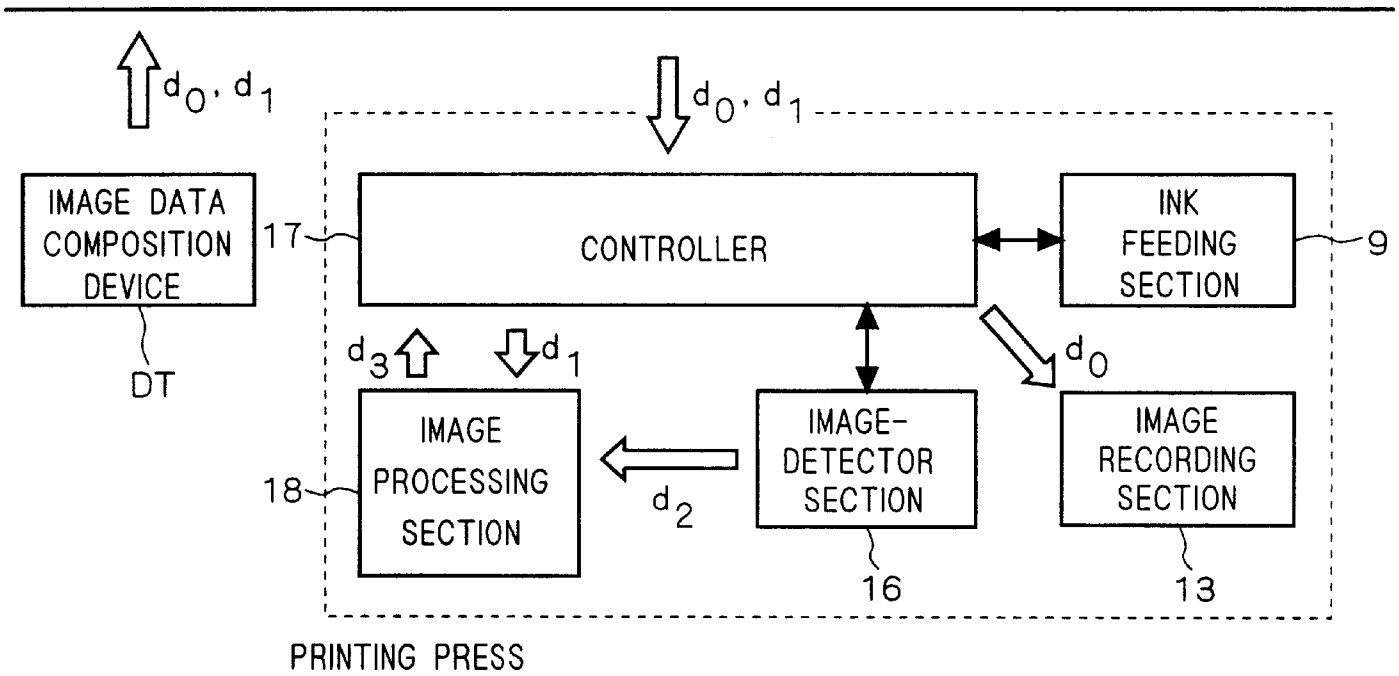
FIG. 2 is a block diagram showing a principal electronic configuration of the printing press.

FIG. 1 is a schematic side view showing a printing press according to a first preferred embodiment of the invention, and FIG. 2 is a block diagram showing a principal electronic configuration of this printing press.

As shown in FIG. 1, the printing press comprises, as printing mechanism, first and second plate cylinders 1, 2 for holding printing plates; first and second blanket cylinders 3, 4 for transferring ink images from the plate cylinders; an impression cylinder 5 for holding printing sheets and transferring ink images from the both blanket cylinders 3, 4; a feeding cylinder 6 and a discharge cylinder 7 for feeding and discharge printing sheets to and from the impression cylinder 5; dampening water feeding means 8 and ink feeding means 9 for feeding dampening water or ink to the printing plates on the first and second plate cylinders 1, 2; a feeding section 10 for sequentially feeding stacked up printing sheets; and a discharge section 11 for stacking up printed sheets sequentially.

On the other hand, as the plate making mechanism, the printing press comprises a printing plate feed section 12 for feeding unexposed printing plates to the first and second plate cylinders 1, 2; an image recording section 13 for recording images on the printing plates on the plate cylinders; a developing section 14 for developing and processing the printing plates on which images are recorded; and a printing plate discharge section 15 for delivering the printed printing plates.

The printing press further comprises an image-detector section 16 for detecting the image on the printed sheet; a controller 17 for controlling respective parts of the printing press; and an image processing section 18 for processing the images obtained in the image-detector section 16.

The detail of each part is as follows: The first plate cylinder 1 is designed to be movable between a first printing position indicated by solid line in FIG. 1 and an image recording position indicated by two-dot chained line by a plate cylinder drive mechanism, and the second plate cylinder 2 is similarly designed to be movable between a second printing position indicated by solid line in FIG. 1 and an image recording position indicated by two-dot chained line by a plate cylinder drive mechanism. That is, when executing the printing operation, the fist and second plate cylinders 1, 2 are positioned at the first and second printing positions, and when executing the plate making operation, they are alternately positioned at the image recording positions, and printing plates are made on the plate cylinders. The first plate cylinder 1 and second plate cylinder 2 respectively have peripheral surfaces for holding printing plates for two colors, and are provided with two sets of gripping means each for fixing each printing plate at 180-degree opposite positions on the circumference.

The first blanket cylinder 3 is designed to contact with on the first plate cylinder 1 at the first printing position and rotate, and the second blanket cylinder 4 also contacts with the second plate cylinder 2 at the second printing position and rotates. The first and second blanket cylinders 3, 4 have the same diameter as the first and second plate cylinders 1, 2, and blankets for transferring ink images of two colors from each plate cylinder are mounted on the circumference.

The impression cylinder 5 has a ½ diameter of the first and second plate cylinders 1, 2, and are designed to rotate by contacting with both the first and second blanket cylinders 3, 4. The impression cylinder 5 has gripping means for holding one printing sheet of a size corresponding to the printing plate. The gripping means is opened and closed at specified timing by an opening and closing mechanism, and holds the leading end of the printing sheet.

The feeding cylinder 6 and discharge cylinder 7 have a same diameter as the impression cylinder 5, and have other gripping means similar to the gripping means provided in the impression cylinder 5. The gripping means of the feeding cylinder 6 and discharge cylinder 7 are arranged to transfer the printing sheet in synchronism with the gripping means of the impression cylinder 5.

The first and second plate cylinders 1, 2 disposed at the first and second printing positions, first and second blanket cylinders 3, 4, impression cylinder 5, feeding cylinder 6, and discharge cylinder 7 are provided with drive gears of the same size as the diameter of each cylinder at each cylinder end, and the gears are meshed between the adjacent cylinders. Therefore, by driving the gears by a print driving motor, the cylinders can be rotate and driven in synchronism with each other.

In the printing press of the preferred embodiment, since the plate cylinders 1, 2 and blanket cylinders 3, 4 have a double peripheral length as compared with the impression cylinder 5, the impression cylinder makes two turns while the plate cylinders 1, 2 and blanket cylinders 3, 4 make one turn. Therefore, when the impression cylinder 5 rotates two turns while holding the printing sheet, two colors plus two colors, that is, a total of four colors are printed from the first and second plate cylinders 1, 2.

Two sets of dampening water feeding means 8 are provided each in the plate cylinders 1, 2 at the first and second printing positions, and dampening water can be selectively supplied to the two printing plates on the plate cylinders 1, 2. The dampening water feeding means 8 comprises a water pan for accumulating dampening water, and a dampening water roller group for taking the dampening water out of the water boat, and transferring onto the printing plate surface. At least the roller contacting with the printing plate surface out of the dampening water rollers is designed to contact with and depart from the plate cylinder surface by a cam mechanism. If the printing plate is of a type not requiring dampening water, the dampening water feeding means 8 is not needed.

Two sets of ink feeding means 9 are disposed each in the plate cylinders 1, 2 at the first and second printing positions, and different color inks can be selectively supplied to the printing plates on the plate cylinders 1, 2. In this embodiment, for example, K-color (black) and M-color (magenta) ink feeding means 9 are disposed on the first plate cylinder 1, and C-color (cyan) and Y-color (yellow) ink feeding means 9 are disposed on the second plate cylinder 2.

Some of the dampening water feeding means 8 and ink feeding means 9 are operable to set aside from the moving path as the first and second plate cylinders 1, 2 move.

Figure 3:
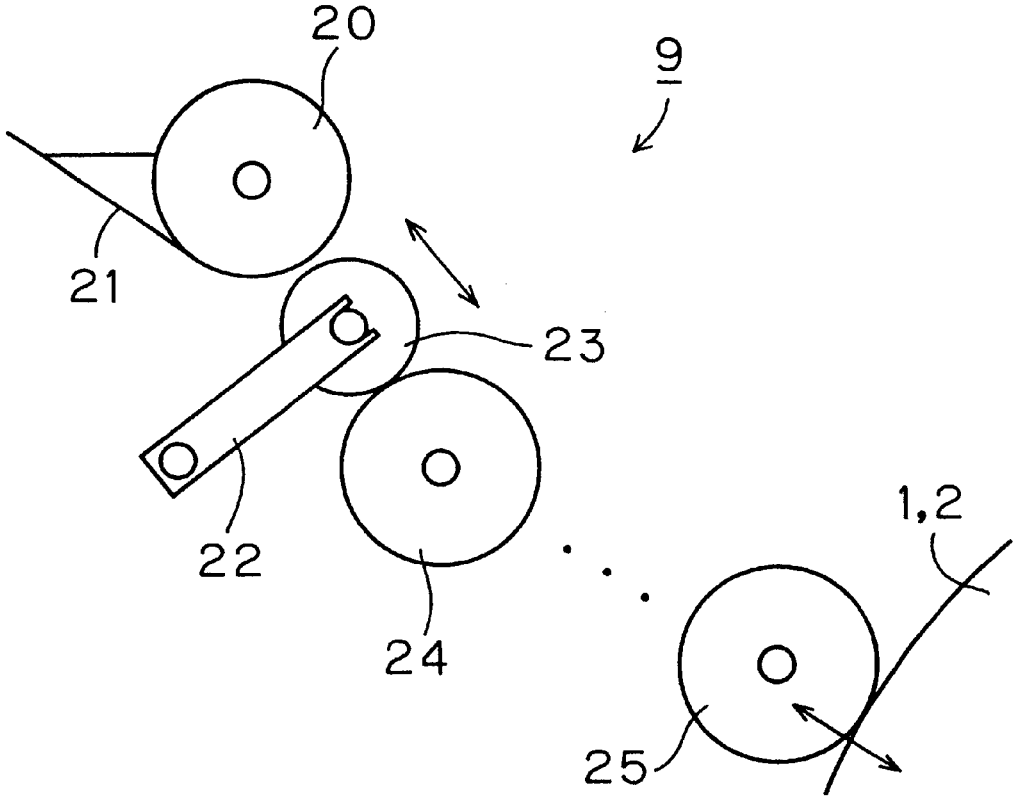
FIG. 3 is a schematic side view showing ink feeding means in the printing press.

The structure of the ink feeding means 9 is explained by referring to FIG. 3. FIG. 3 is a schematic side view showing an example of the ink feeding means 9. In FIG. 3, the ink feeding means 9 comprises an ink fountain roller 20 and an ink key 21 for composing an ink fountain device; an ink doctor 23 disposed so as to swing with an arm 22, plurality of ink rollers 224; and a form roller 25 for feeding ink in contact with the printing plate surface. Only one ink roller 24 is shown in FIG. 3.

The ink fountain means has the ink key 21 made of a thin metal plate contacting with the peripheral surface of the ink fountain roller 20 provided along the axial line of the plate cylinder, and this ink key 21 is divided in plurality of sections along the axial direction of the ink fountain roller 20. The ink is stored in an ink groove space formed by the ink fountain roller 20, ink key 21, and side plate not shown in the drawing.

Each ink key 21 is designed to be independently driven by a drive screw and other elements in a direction for contacting with or departing from the surface of the ink fountain roller 20 and the respective clearances (apertures) of the ink fountain roller 20 and ink key 21 can be adjusted. By rotating the ink fountain roller 20 in the counterclockwise direction in the drawing, the ink comes out on the surface of the ink fountain roller 20 in a film thickness corresponding to the aperture. This is the mechanism for controlling or changing the ink feed rate.

The ink doctor 23 reciprocates between the ink fountain roller 20 and the ink roller 24 by the move of the arm 22, and by contacting alternately with the ink fountain roller 20 and ink roller 24, the ink on the ink fountain roller 20 is transferred onto the ink roller 24.

The ink rollers 24 are a plurality of rollers made of metal or rubber, which are arranged so as to contact with each other sequentially, and some of them swing and move in the axial direction of the roller. The ink is kneaded by the ink rollers.

The form roller 25, in a state contacting with at least one ink roller 24, contacts with or departs from the periphery of the first plate cylinder 1 or second plate cylinder 2 by a cam mechanism. As a result, the ink of the color corresponding to the printing plate corresponding to the plate cylinder is supplied.

In this ink feeding means 9, by adjustment of aperture of the ink key 21, the ink feed rate of each color can be controlled along the axial direction of the plate cylinder (orthogonal direction to the printing direction).

Back to FIG. 1, the feeding section 10 is to pick up sheet by sheet from a pile of printing sheets, and transfer to the feeding cylinder 6, and in this embodiment, it operates to feed the sheet once in every two revolutions of the feeding cylinder. The discharge section 11 is to receive the printed sheets from the discharge cylinder 7, and stack them up, and the detail of the discharge section 11 is described later.

The plate making mechanism of the printing press is explained. In this printing press, when executing plate making process, the first and second plate cylinders 1, 2 are moved alternately to the image recording position. At this image recording position, a friction roller not shown contacting with the plate cylinder, and is driven to rotate.

The printing plate feeding section 12 comprises a cassette roll storing a roll of unexposed printing plate shielded from light; conveying roller and conveying guide for conveying the drawn printing plate up to the plate cylinders 1, 2; and cutting means for cutting the printing plate into sheets. In this embodiment, a silver salt photosensitive material is used as the printing plate, and an image is recorded by laser beam. The feeding operation procedure of printing plate comprises the steps of gripping the leading end the printing plate drawn out from the cassette roll by the gripping means of the plate cylinders 1, 2; rotating the plate cylinders 1, 2 and winding the printing plate around the plate cylinders 1, 2; cutting the printing plate to a specified length; and gripping the rear end of the printing plate by the other gripping means.

The image recording section 13 is intended to record an image by exposing on the printing plate through on/off control of the laser beam. In this embodiment, the printing plate surface is scanned by the laser beam emitted from the laser transmission source and deflected by polygon mirror or other deflector along the axial direction of the plate cylinder while rotating the plate cylinder. The image recording section 13 may be constructed so as to record an image by moving continuously or intermittently a recording head for irradiating a plurality of laser light beams along the axial direction of the plate cylinder while rotating the plate cylinder. The printing plate and image recording section 13 are not limited to this principle of recording image through photo-exposure, but may be designed to record image through heating or discharging process.

The developing section 14 is to develop and process the printing plate exposed by the image recording section 13. In this embodiment, the developing section 14 is designed to applying developing process by taking the processing fluid out of a processing tank and applying the same onto the printing plate by an application roller, and comprises elevating means for moving from the plate cylinder to waiting position and to a position approaching the plate cylinder. In the case of the image recording system not requiring development process, the developing section 14 is not needed.

In this printing press, the first and second developers 1, 2 are moved to the image recording position, and the plate making operation is executed by feeding the printing plate and recording and developing the image. When the plate making process is completed, the first and second plate cylinders 1, 2 are brought into the first and second printing positions, and the printing operation is started.

On the other hand, this printing press is designed to deliver the printing plate automatically after the printing operation. In the embodiment, the printing plate discharge section 15 comprises stripping means for releasing the printing plate from the plate cylinder at the image recording position, conveying means for conveying the released printing plate, and a discharge cassette for delivering the used printing plate being conveyed.

Figure 4:
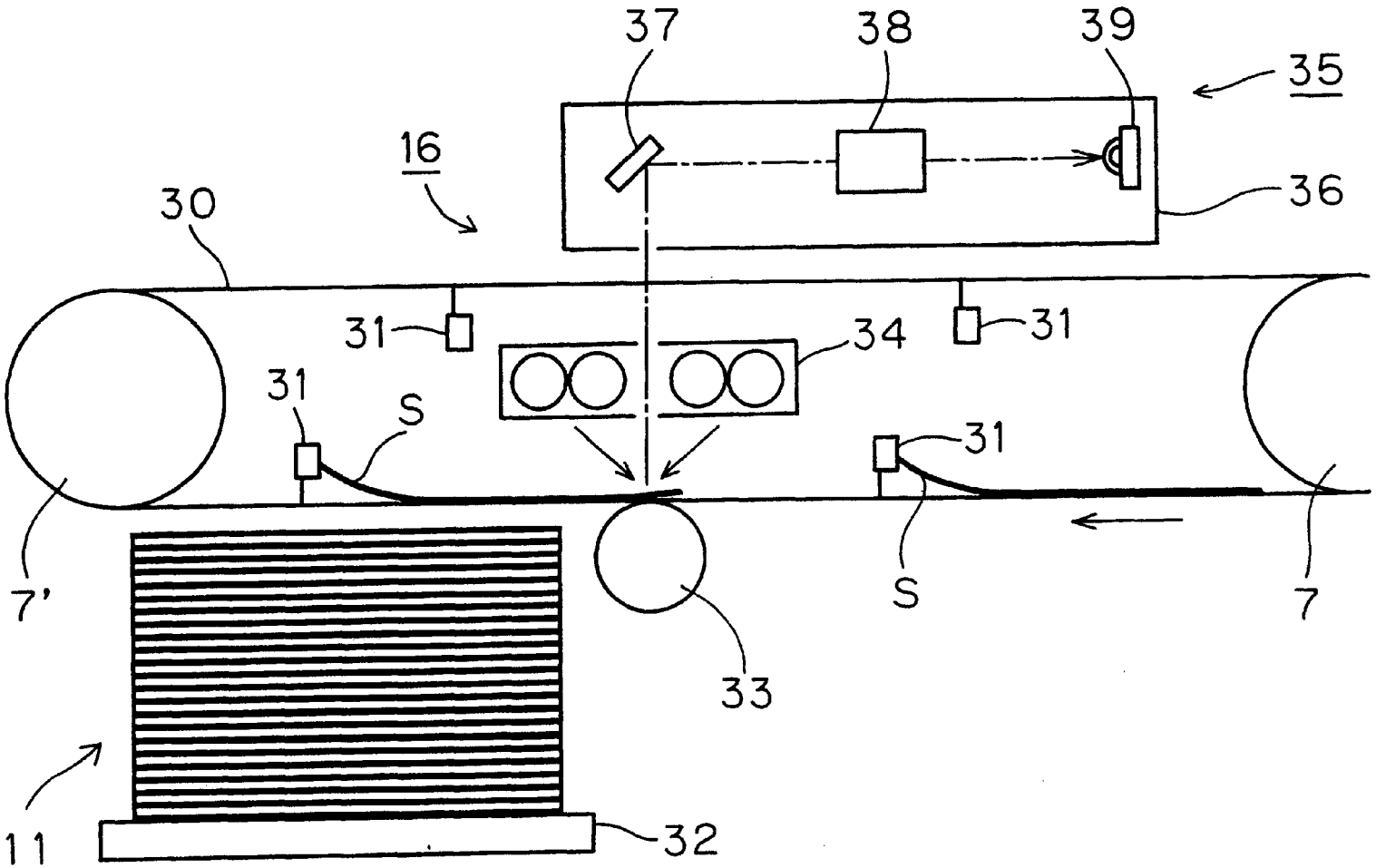
FIG. 4 is a schematic side view sowing a discharge section and an imaging section in the printing press.

Referring to FIG. 4, the configuration of the imaging section 16 and discharge section 11 of the embodiment is explained. FIG. 4 is a schematic side view near the discharge section 11.

The discharge section 11 comprises the discharge cylinder 7, two endless chains 30 applied between two gears 7' of nearly same diameter as the discharge cylinder 7, a plurality of gripping means 331 conveyed by the two chains and conveying printing sheets S, and a discharge tray 32 for stacking up the printing sheets conveyed by the gripping means 31.

At both ends of the discharge cylinder 7, gear units are provided to be engaged with the chains 30, and two gears 7' of nearly same diameter are disposed oppositely to the gear units. Endless chains 30 are applied between the gear units of the discharge cylinder 7 and the gears 7'. The length of the chain 30 is set to a length of an integer multiple of the peripheral length of the discharge cylinder.

The gripping means 31 has a pawl member which opens and closes to grip the leading end of the printing sheet S, and a plurality of gripping means 31 are fixed between the two chains. The interval of the gripping means corresponds to the peripheral length of the discharge cylinder 7. The gripping means 31 runs in a loop form in synchronism with rotation of the discharge cylinder 7. On the other hand, each gripping means 31 is designed to open and close in synchronism with the gripping means provided in the discharge cylinder 7 by means of a cam mechanism, so as to receive the printing sheet S from the discharge cylinder 6 and deliver the printing sheet S onto the discharge tray 32.

The discharge tray 32 is a pallet member on which a plurality of printing sheets S are stacked up, and is moved up and down by elevating means. That is, as the printing sheets S are delivered, the discharge tray 32 sequentially descends to keep constant the discharge height of the printing sheets S, so that the printing sheet S may be smoothly delivered.

In the discharge section 11, since the leading end of the printing sheet S is conveyed while gripped by the gripping means 31, the rear end of the printing sheet S is conveyed in a free state without being fixed, and hence the printing sheet S may flap in the course of conveying. In the embodiment, to suppress flapping of the printing sheet S, a suction roller 33 is provided as stabilizing means for stabilizing the conveying state of the printing sheet S at the forward side of the discharge tray 32.

The suction roller 33 has multiple fine suction pores on the surface, and is connected to a vacuum pump. The suction roller 33 is disposed so that its roller axial line may be parallel to the gripping means 31, and that the top of the roller may be positioned nearly at the same height as the lower path of the chains 30. The suction roller 33 is designed to be driven to rotate in accordance with the passing speed of the gripping means 31, or to be free to passively rotate only. Therefore, since the printing sheet S is conveyed in a state being sucked to the surface of the suction roller when passing over the suction roller 33, the printing sheet S does not flap above the suction roller 33. Instead of the suction roller 33, a suction plate member for sucking the printing sheet S flatly may be also employed.

The imaging section 16 comprises illuminating means 334 for illuminating the conveyed printing sheet, and imaging means for detecting the image on the illuminated printing sheet to obtain image data.

The illuminating means 34 includes a plurality of linear light sources disposed along the suction roller 33 for illuminating the printing sheet on the suction roller 33, and is provided between the chains 30. An imaging slit is formed in the middle of the light sources.

The imaging means 35 comprises a casing 36 for shielding light and protecting from dust, and a mirror 37, a lens 38, and a CCD line sensor 39 incorporated in this casing. This imaging means 35 is designed to detect the image on the printing sheet running on the suction roller 33 through the slit in the illuminating means 34, and the incident light of the image reflected from the mirror 37 is received in the CCD line sensor 39 through the lens 38. The CCD line sensor reads images corresponding to three colors of R (red), G (green) and B (blue). In this embodiment, as the printing sheet is moved, the image on the printing sheet is sequentially read by each scanning line.

The controller 17 and image processing section 18 shown in FIG. 2 will be now explained. As shown in the block diagram in FIG. 2, the printing press comprises the controller 17 for controlling the parts of the printing press including the ink feeding means 9, image recording section 13, imaging section 16, and image processing section 18. The controller 17 is a microcomputer system composed of CPU, various input and output means, display means, storage means, and input and output interface, and is connected to an external image data composition device DT through LAN or the like.

The image data composition device DT is, for example, DTP (desktop publishing) device or RIP (raster image processing) device for converting the image data into binary image data of bit map format, and is designed to supply the image data into the printing press. In this embodiment, the image data to be supplied is binary image data d0 representing a halftone dot image having been subjected to RIP, and image data $d_1$ for ink feed rate control.

The binary image data d0 is sent out to the image recording section 13, and an image is recorded on the printing plate according to the image data. That is, depending on the binary value of the image data d0, the laser beam is controlled to be on/off thereby the image is recorded.

In this embodiment, the image data $d_1$ for ink feed rate control is obtained by reducing the resolution of PPF (print production format) image data in the CIP3 (International Cooperation for Integration of Prepress, Press, and Postpress) standard from which the binary image data d0 for actually recording an image on the printing plate is generated through the RIP processing. Each pixel of the image data $d_1$ is expressed in multilevel value in each color component R, G, B. The image data $d_1$ is processed in the image processing section 17, and is used in control of ink feed rate.

In the embodiment, the binary image data d0 and image data $d_1$ for ink feed rate control are obtained from the external image data composition device DT, but instead, for example, the printing press may input the image data before RIP and generate the image data d0 for actual image recording and the image data $d_1$ for ink feed rate control through the RIP and resolution reduction in the printing press, respectively. Further, the image data $d_1$ may be identical to the original image data of high resolution in place of the image data of low resolution which is effective to reduce the load of the subsequent operation.

The image processing section 18 operates to obtain correction data $d_3$ for adjusting the aperture of ink key in the ink feeding means 9, on the basis of the image data $d_1$ and image data $d_2$ taken by the imaging section 16, being composed of a microcomputer system comprising CPU, various input and output means and storage mean. In the embodiment, the controller 17 and image processing section 18 are composed of independent microcomputer systems, but they may be composed in a common microcomputer system.

Figure 5:
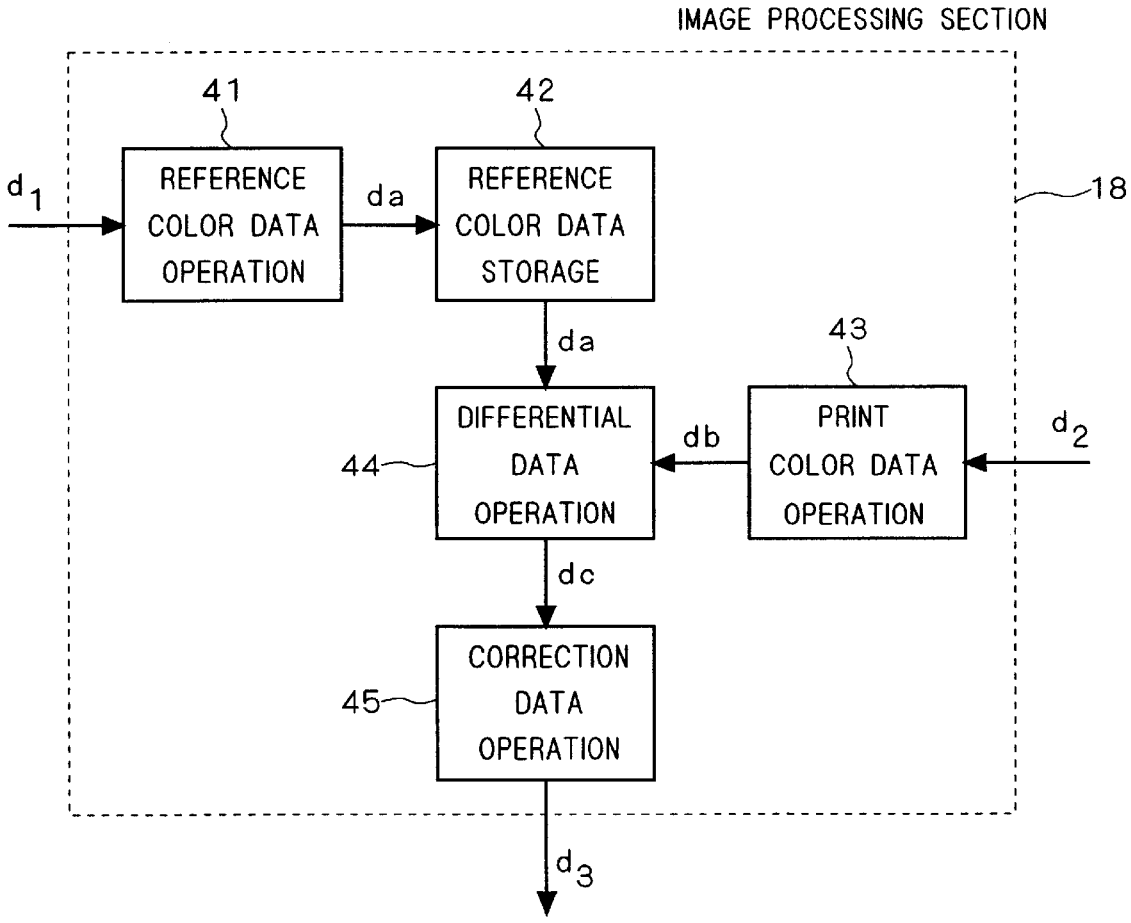
FIG. 5 is a functional block diagram showing a functional configuration of image processing section in the printing press.

A functional configuration of the image processing section 18 is explained by referring to a functional block diagram in FIG. 5. In FIG. 5, the image processing section 18 comprises reference color data operating means 41 for calculating reference color data $d_a$ by converting the image data $d_1$ into a predetermined color coordinate system; storage means 42 for storing this reference color data $d_a$; print color data operating means 43 for calculating print color data $d_b$ by converting the image data $d_2$ obtained by the imaging section 16 in to the color coordinate system; differential data operating means 44 for calculating differential data dc by comparing the reference color data $d_a$ and print color data $d_b$, with each other; and correction data operating means 45 for calculating correction data $d_3$ for adjusting the aperture of the ink key 21 of the ink feeding means 9 from the obtained differential data $d_c$.

Figure 7:
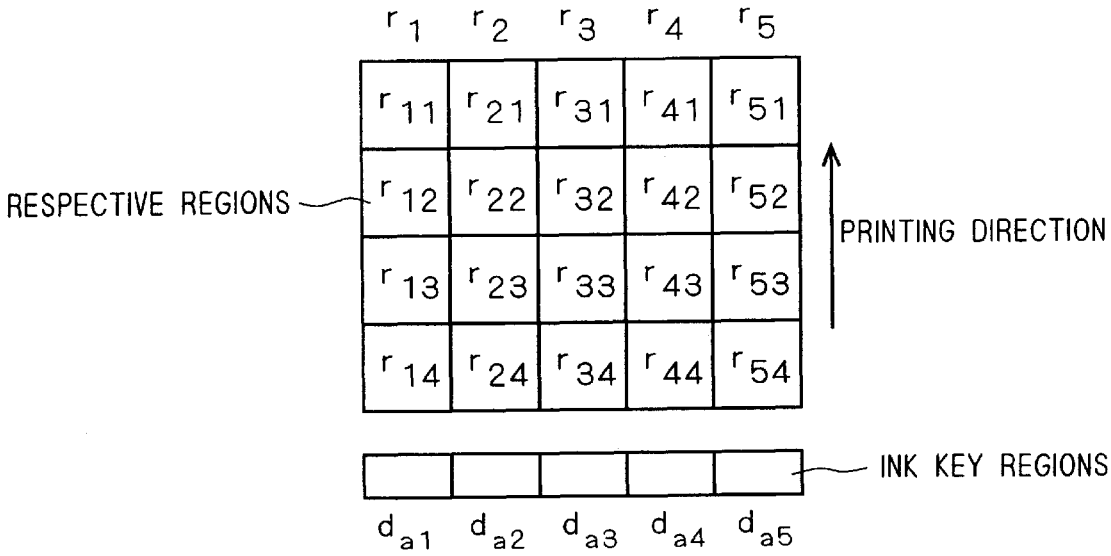
FIG. 7 is an explanatory diagram of image region.

The reference color data operating means 41 first divides the image data $d_1$ of PPF format into a plurality of regions according to the region width of each ink key 21 of the ink feeding means 9. This division is as shown in FIG. 7. FIG. 7 is a diagram for explaining the division of the image data $d_1$, in which the ink key region in the printing width direction is divided into five, and the printing direction is divided into four regions, for convenience of illustration. In each region, an average color value for R-, G-, B-components is numerically converted into the L*a*b* color coordinate system. Next, in each width region of ink key, an additional average of the numerical values in the color coordinate system are calculated for the regions $r_1$–$r_4$ each extending in the printing direction Dp. That is, in the example in FIG. 7, the numerical color coordinate values in each four regions $r_{11}$–$r_{14}$; $r_{21}$–$r_{24}$; $r_{31}$–$r_{34}$; $r_{41}$–$r_{44}$; $r_{51}$–$r_{54}$ are additionally averaged in the column direction to obtain the reference color data $d_a$ ($d_{a1}$, $d_{a2}$, $d_{a3}$, $d_{a4}$). The division width in the printing direction may be set to a proper width in connection with operation performance.

The reference color data $d_a$ may the same values unless the printing plate is changed, and therefore, the standard values thereof are calculated and stored in the storage means 42. The conversion from the R, G, B color coordinate system to the L*a*b* color coordinate system may be based on a known conversion arithmetic.

The print color data operating means 43 processes the image data $d_2$ obtained by the imaging means by the same technique as the operation of the reference color data $d_a$, to thereby obtain the print color data $d_b$. Since the image data $d_2$ is obtained for each predetermined sampling interval, the print color data $d_b$ is sequentially operated. The reading resolution of the image data $d_2$ is preferred to be set according to the resolution of the image data $d_1$.

The differential data operating means 44 compares the reference color data $d_a$ with the print color data $d_b$ in every ink key region to calculate the differential data $d_c$. That is, it is the differential data $d_c$ that numerically expresses the difference between the reference color data $d_a$ and the print color data $d_b$ which represents how the actual print color is finished as compared with the original image data in numerical value of the L*a*b* color coordinate system, The correction data operating means 45 first operates the density value of each ink of Y (yellow), M (magenta), C (cyan), K (black) from the differential data $d_c$. That is, the differential data $d_c$ expresses the color difference in the color coordinate system, and this color difference is converted into the density value of inks of four colors Y, M, C, K to be used actually. For this conversion, a predetermined conversion table is used. The conversion table represents relations between color values defined in the L*a*b* color coordinate system and the ink densities corresponding to the color values, where the color values are defined to increase step by step and the ink densities are determined by detecting the actual color densities of respective regions of a color chart with a chronometer.

After the density value of the ink of each color is obtained in each ink key region from the differential data $d_c$, the correction data $d_3$ expressing correction amount of the apertures of each ink key 31 corresponding to the density value is obtained for each color. This may be attained with a conversion table prepared to convert respective amounts of the ink density to be changed and the correction values of the aperture of the ink key corresponding thereto, for example.

On the basis of the obtained correction data $d_3$, the controller 17 adjusts the aperture of the ink key of each ink feeding means 9.

Figure 6:
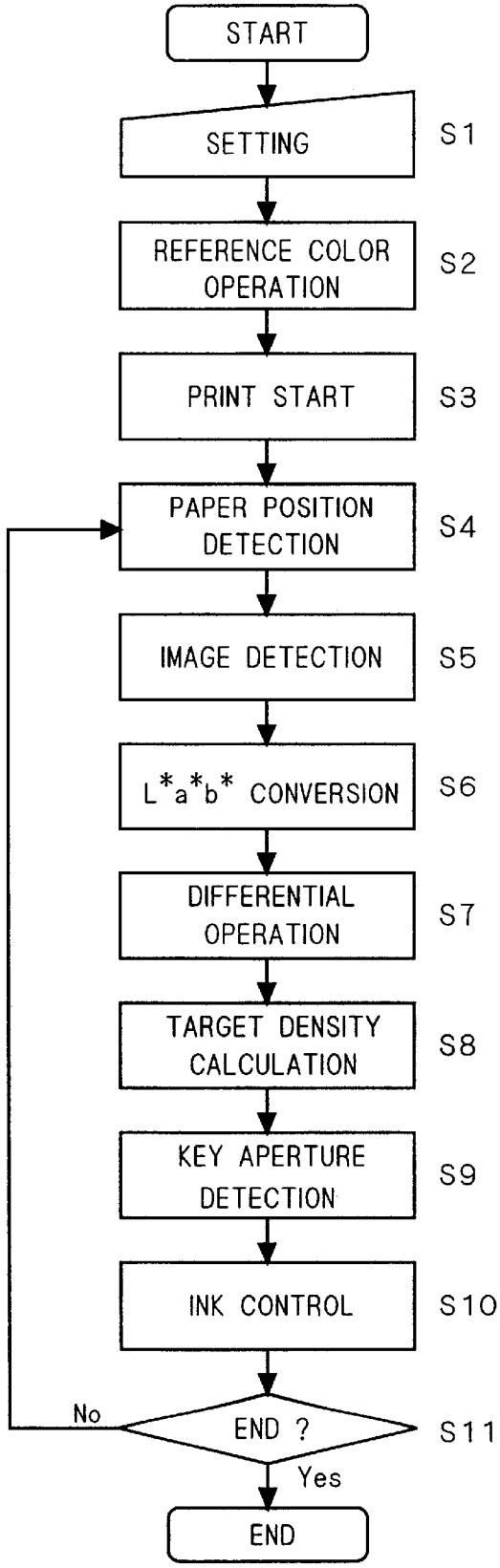
FIG. 6 is a flowchart showing control procedure of ink feed rate in the printing press.

The control procedure of ink feed rate in the preferred embodiment will be now explained with reference to the flowchart in FIG. 6.

At step S1, the operator sets respective parameters of the printing press, which may include the sampling interval of the imaging section 16, number of prints, printing speed, and various conditions, for example.

At step S2, the printing press inputs image data $d_0$, $d_1$ from the external image data composition device DT. The image data $d_1$ is transferred to the image processing section 18, and the reference color data $d_a$ is calculated from the image data $d_1$ in the reference color data operating means 41. The obtained reference color data $d_a$ is stored in the storage means 42.

At step S3, the printing press executes the plate making process according to the image data $d_0$, and then starts the printing process. The initial aperture of the ink key of the ink feeding means 9 is set according to the reference color data $d_a$.

Control procedure of ink feed rate is started from step S4. That is, at step S4, the position of a printing sheet is detected by a sensor (not shown). For example, the position of the gripping means 31 of the discharge section 11 is detected by the sensor, or the position of the printing sheet being conveyed is detected optically.

At step S5, in response to the detection of the position of the printing sheet, the imaging section 16 starts to detect the image on the printing sheet. As a result, image data $d_2$ is obtained. The image data $d_2$ may involve an error in the reading position due to deviation of the conveyance timing of the printing sheet or mechanical vibration. In order to compensate the error, it is preferred to determine the position of the printing sheet by extracting a printed register mark or the like by image processing.

At step S6, the print color operating means 43 converts the image data $d_2$ to obtain the print color data $d_b$.

At step S7, the differential data operating means 44 compares the reference color data $d_a$ and the print color data $d_b$ to obtain the differential data $d_c$.

At step S8, the correction data operating means 45 calculates the target ink density value from the differential data $d_c$. At step S9, from the obtained ink density value, correction data $d_3$ for adjusting the aperture of each ink key is determined. The obtained correction data $d_3$ is transferred to the controller 17.

At step S10, on the basis of the obtained correction data $d_3$, the controller 17 adjusts the aperture of each ink key 31 of each ink feeding means 9. The feedback control is effected for the ink feed rate.

At step S11, judging if the printing operation is completed or not, and the operation is terminated when the printing operation is completed. If the printing operation continues, the routine returns to step S4 and the adjustment of ink feed rate is repeated at a predetermined sampling interval.

According to the preferred embodiment, since the reference color data is obtained from the image data directed to record the image on the printing plates, it is not necessary to prepare OK-sheet or other reference printed sheets.

2. Second Preferred Embodiment

Figure 8:
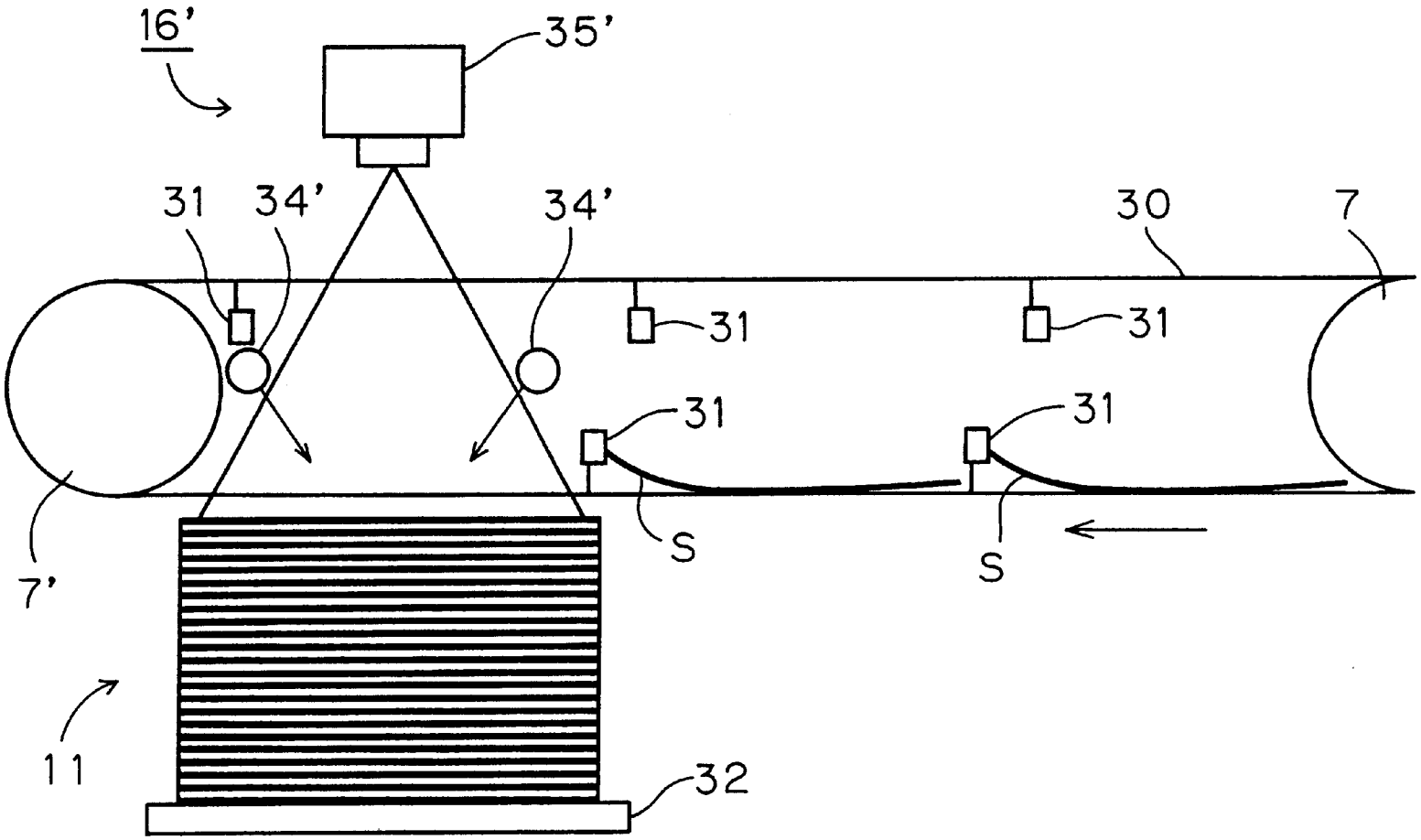
FIG. 8 is a schematic side view showing an imaging section according to another preferred embodiment.

FIG. 8 is a schematic sectional view showing an example of imaging section according to a second preferred embodiment of the present invention. In the first preferred embodiment, the CCD line sensor 39 is used in the imaging means 35, but in the second preferred embodiment, the imaging means is replaced by two-dimensional imaging means 35' composed of a two-dimensional CCD camera capable of taking a two-dimensional image on a printing sheet in one shot. This two-dimensional imaging means 35' of relatively low resolution can be employed because the image data $d_2$ is used for the purpose of control of ink feed rate and the resolution is low. Therefore, high resolution is not required in the two-dimensional imaging means 35', and, for example, a two-dimensional CCD camera of about 700,000 pixels is applicable.

In the second preferred embodiment, the image on the printing sheet is not read for each scanning line and the mechanism for stabilizing the conveying process of a printing sheet is not needed. The mechanism of the second preferred embodiment shown in FIG. 8 is same as the mechanism of the first preferred embodiment except that the illuminating means 34' is shifted to a position away from the imaging region of the two-dimensional imaging means 35'.

3. Third Preferred Embodiment

In the first and second preferred embodiments, the ink feed rte is controlled by taking the image on the printing sheet, but, alternatively, by forming a color chart for ink control preliminarily on the printing plate, the color chart printed on the printing sheet may be detected.

In the case of the third preferred embodiment, once the color chart to be preliminarily recorded in the image recording section 13 is specifically determined, the reference color data $d_a$ is constant without preparing reference color data $d_a$ from the image data $d_1$ in each printing plate as required in the first and second preferred embodiments. Accordingly, the reference color data $d_a$ corresponding to the color chart is once determined and is stored in the storage means 42.

Figure 9:
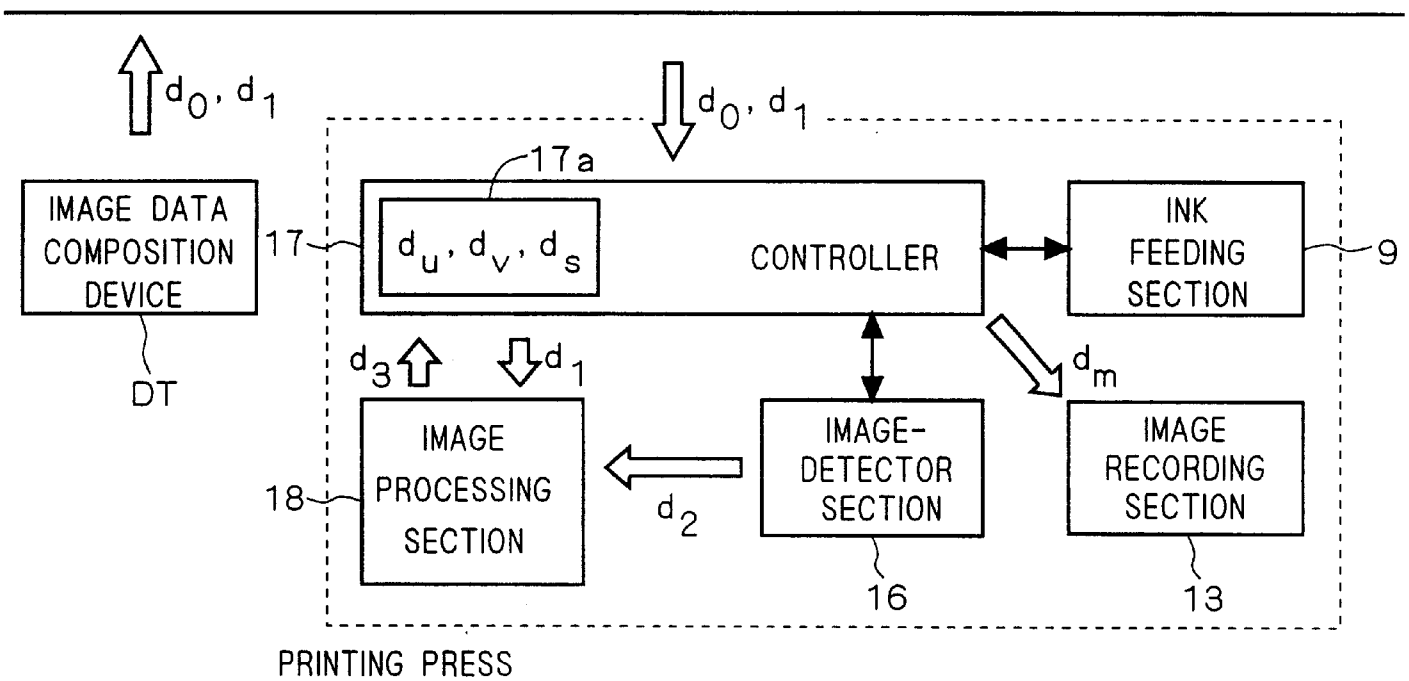
FIG. 9 is a block diagram showing a principal electronic configuration according to another preferred embodiment of the invention.
Figure 10:
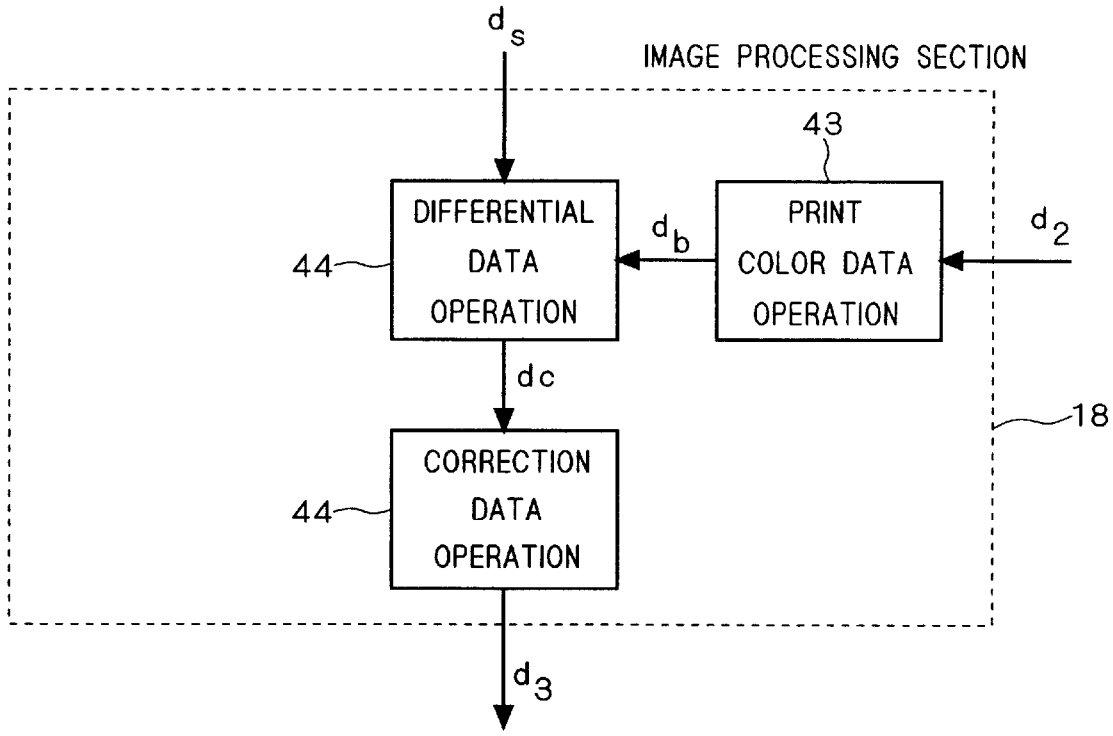
FIG. 10 is a functional block diagram showing a functional configuration of image processing section according to the another preferred embodiment of the invention.

Although it is required to form a specific color chart on the printing plate, it is easily achieved in a printing press incorporating a plating making mechanism. For example, image data $d_u$, $d_v$ expressing a predetermined color chart are stored in a memory or a disk of the controller 17 whereby color chart storage means 17*a* is obtained (FIG. 9). Specifically, the image data $d_u$ is binary image data preliminarily processed by RIP. When forming an image on a printing plate, the image data $d_u$ corresponding to the color chart is added to image data $d_0$ for composing the print to obtain combined image data $d_m$ is obtained. Then, a combined image is recorded on the printing plate on the basis of the combined image data $d_m$. Such combination of image data is easily achieved, as shown in FIG. 10, by forming a color chart 63 in a blank area 62 (end portions of the image data $d_0$, $d_1$ not containing substantial data) of an image forming region 61 of the printing plate PL.

Figure 11:
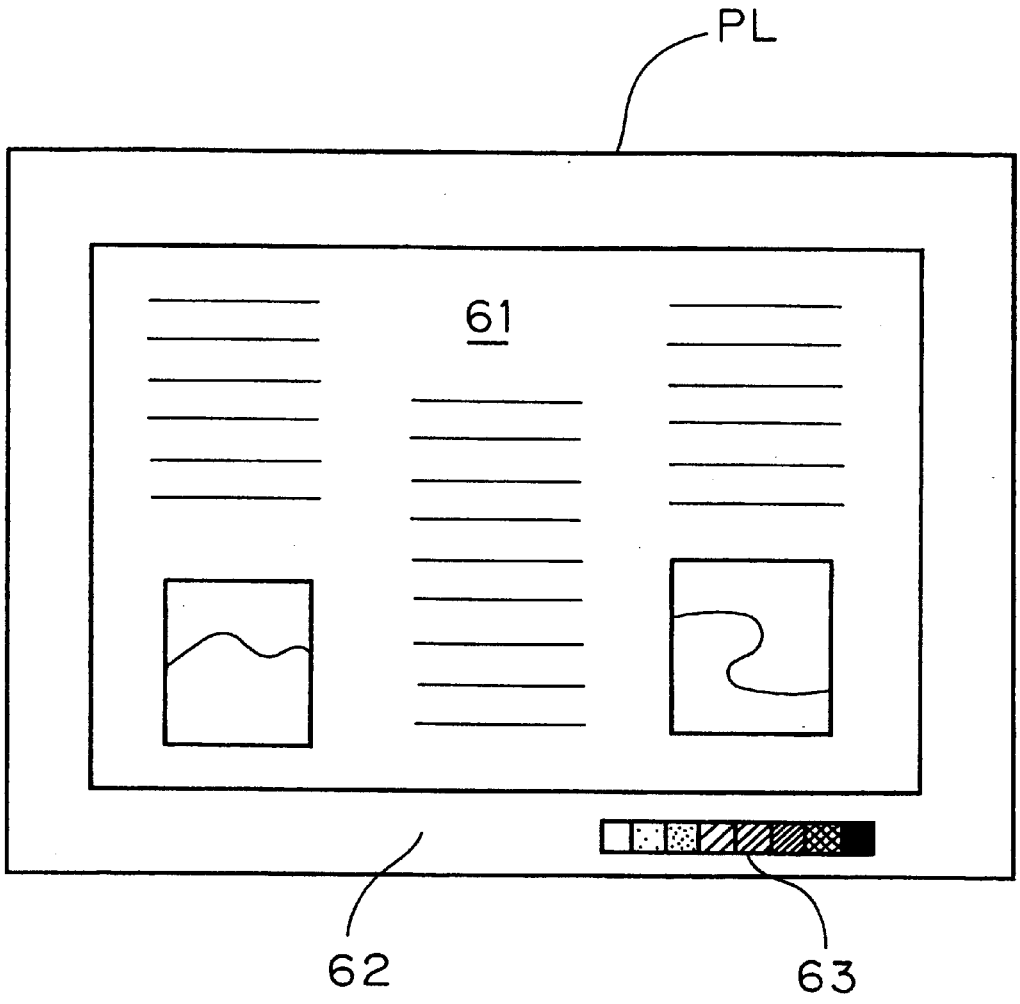
FIG. 11 is a diagram showing an example of layout region of color chart.

On the other hand, the image data $d_v$ expresses a plurality of color densities of the color chart region in the B, G, R color coordinate system, and is used in ink control in the color chart region. Image data $d_s$ obtained by converting this image data $d_v$ preliminarily into numerical values in the L*a*b* color coordinate system is also stored in the color chart storage region 17*a*. As shown in FIG. 11, this image data $d_s$ is given to the differential data operating means 44. The subsequent process is same as in the first and second preferred embodiments.

In this example, the image of the color chart is combined with the objective print image in the printing press, but the image data $d_u$ of the color chart may be also preliminarily incorporated in the image data $d_0$ in the image data composition device DT.

In the case of the preferred embodiment, too, as the imaging means, either the line sensor shown in the first preferred embodiment or the two-dimensional sensor in the second preferred embodiment may be used. In the latter case, however, instead of the whole area of the printing plate surface, the image may be taken only in a predetermined region in which the color chart is formed.

While the invention has been shown and described in detail, the foregoing description in all aspects illustrative and not restrictive. It is therefore understood that numerous other modifications and variations can be devised without departing from the scope of the invention.

What is claimed is:

1. A printing press for printing sheets on the basis of first image data comprising:

plate making means for adding color chart image data expressing a predetermined color chart to said first image data to generate combined image data, and forming an image corresponding to said combined image data on a printing plate, ink feed means capable of changing ink feed rates of ink supplied onto a plurality of regions of said printing plate, reference color data storage means for storing a numerical value of each color included in said color chart in a predetermined color coordinate system as reference color data, image-detecting means for detecting an image of the color chart on said printing sheet transferred from said printing plate to thereby obtain second image data, print color data operating means for converting said second image data into said color coordinate system to obtain print color data, differential data operating means for comparing said reference color data with said print color data to obtain differential data, correction data operating means for obtaining correction data of said ink feed rate with respect to each of said plurality of regions, on the basis of said differential data, and control means for controlling the amount of ink to be fed onto said plurality of regions by said ink feed means on the basis of said correction data.

2. The printing press according to claim 1, further comprising:

color chart storage means for storing the color chart image data, wherein said plate making means adds said color chart image data being read out from said color chart storage means to said first image data, and generates said combined image data.

3. The printing press according to claim 2, wherein said printing sheet has a leading end and a rear end, said printing press further comprises:

discharge means for delivering said printing sheet by gripping said leading end, and stabilizing means for stabilizing a conveying state of said printing sheet being discharged, wherein said image-detecting means detects said image on said printing sheet stabilized by said stabilizing means in said conveying state.

4. The printing press according to claim 2, further comprising:

a discharge storage for stacking up and accumulating a plurality of printed sheets sequentially on a platform, wherein said image-detecting means has two-dimensional image-detecting means capable of detecting a whole image region of a top printing sheet of a plurality of printing sheets stacked up on said discharge storage.

5. A printing press for printing sheets on the basis of first image data comprising:

an image recorder adding color chart image data expressing a predetermined color chart to said first image data to generate combined image data, and forming an image corresponding to said combined image data on a printing plate, an ink fountain device provided with an ink key capable of changing ink feed rates of ink supplied onto a plurality of regions of said printing plate, a reference color data storage storing a numerical value of each color included in said color chart in a predetermined color coordinate system as reference color data, a CCD sensor detecting an image of the color chart on said printing sheet transferred from said printing plate to thereby obtain second image data, an image processor converting said second image data into said color coordinate system to obtain print color data, to compare said reference color data with said print color data to obtain differential data, and to obtain correction data of said ink feed rate with respect to each of said plurality of regions, on the basis of said differential data, and a controller controlling the amount of ink to be fed onto said plurality of regions by said ink fountain device on the basis of said correction data.

6. The printing press according to claim 5, further comprising:

color chart storage storing the color chart image data, wherein said image recorder adds said color chart image data being read out from said color chart storage to said first image data, and generates said combined image data.

7. The printing press according to claim 6, wherein said printing sheet has a leading end and a rear end, said printing press further comprises:

a discharge gripper delivering said printing sheet by gripping said leading end, and a suction roller stabilizing a conveying state of said printing sheet being discharged, wherein said CCD sensor detects said image on said printing sheet stabilized by said stabilizing means in said conveying state.

8. The printing press according to claim 6, further comprising:

a discharge tray stacking up and accumulating a plurality of printed sheets sequentially on a platform, wherein said CCD sensor has a two-dimensional image-detecting sensor capable of detecting a whole image region of a top printing sheet of a plurality of printing sheets stacked up on said discharge tray.

* * * * *